US010220920B1

(12) United States Patent
Holseberg et al.

(10) Patent No.: US 10,220,920 B1
(45) Date of Patent: Mar. 5, 2019

(54) BOAT DRIVER DOOR AND LADDER ASSEMBLY

(71) Applicants: Hutch Holseberg, Charleston, SC (US); Tom Marlowe, Summerville, SC (US); Steven O'Connell, Holly Hill, SC (US); Niki O'Connell, Holly Hill, SC (US); Timothy Goings, Summerton, SC (US); Michael Marlowe, Moncks Corner, SC (US); Ron Inabinett, Charleston, SC (US)

(72) Inventors: Hutch Holseberg, Charleston, SC (US); Tom Marlowe, Summerville, SC (US); Steven O'Connell, Holly Hill, SC (US); Niki O'Connell, Holly Hill, SC (US); Timothy Goings, Summerton, SC (US); Michael Marlowe, Moncks Corner, SC (US); Ron Inabinett, Charleston, SC (US)

( * ) Notice: Subject to any disclaimer, the term of this patent is extended or adjusted under 35 U.S.C. 154(b) by 0 days.

(21) Appl. No.: 15/834,806

(22) Filed: Dec. 7, 2017

(51) Int. Cl.

| | |
|---|---|
| ***B63B 27/14*** | (2006.01) |
| ***B63B 7/08*** | (2006.01) |
| ***B63B 19/08*** | (2006.01) |
| *B63B 7/00* | (2006.01) |

(52) U.S. Cl.
CPC ..... *B63B 27/146* (2013.01); *B63B 7/082* (2013.01); *B63B 7/085* (2013.01); *B63B 19/08* (2013.01); *B63B 2007/003* (2013.01); *B63B 2211/04* (2013.01)

(58) Field of Classification Search
CPC . B63B 2027/141; B63B 27/146; B63B 19/08; B63B 2029/022
See application file for complete search history.

(56) References Cited

U.S. PATENT DOCUMENTS

| | | | | |
|---|---|---|---|---|
| 2,558,975 A | | 7/1951 | Moreno et al. | |
| 4,742,795 A | * | 5/1988 | DePrey | B63B 19/08 114/343 |
| 5,537,949 A | | 7/1996 | Blevins et al. | |
| 7,004,101 B1 | | 2/2006 | Mardikian | |
| 7,438,014 B2 | | 10/2008 | Kim | |
| 8,800,470 B1 | | 8/2014 | Cummings | |
| 9,120,540 B1 | | 9/2015 | Foss et al. | |
| 2010/0229781 A1 | * | 9/2010 | Garelick | B63B 27/146 114/362 |

* cited by examiner

*Primary Examiner* — Andrew Polay
(74) *Attorney, Agent, or Firm* — Southeast IP Group, LLC.; Thomas L. Moses

(57) ABSTRACT

A dive door and ladder assembly includes a door positioned on the side of a boat, preferably in a rearward or aft position. The dive door is attached to a horizontally oriented hinge on a bottom portion thereof, and opens by pivoting inwardly and downwardly (vertically). When the door is in an open position, the underside of the door is generally in a horizontal plane with the upper surface of the doorway, forming a platform for divers and snorkelers to stand on. The upper surface of the doorway further includes a small hatch that may be opened to reveal a compartment therebelow. A collapsible ladder may be positioned within the compartment, in a collapsed state, and may be pulled upwardly from the compartment and folded over the side of the boat, through the doorway and extended into the water.

13 Claims, 9 Drawing Sheets

BOAT DRIVER DOOR AND LADDER ASSEMBLY

FIELD OF THE INVENTION

The present invention relates generally to diver doors and ladder assemblies for watercraft. More specifically, the present invention is directed to a diver door assembly having a hinged door, which may be in a closed position, or in an open position, and which includes a compartment for a collapsible ladder for entry and egress.

BACKGROUND OF THE INVENTION

It is not uncommon for boats that are used for scuba diving, snorkeling, and the like to have a platform, ladder or other means for users to get into the water, and back into the boat. In recent years, some boats have come equipped with dive doors, which are simply doors that are generally positioned either in the transom or the side of the boat. The doors remain in the closed position while the watercraft is underway, and are opened when the boat is anchored or drifting. Many such dive doors include attachable ladders, so that divers and snorkelers may easily get into and out of the water.

Previous examples of such dive doors include the following patents, which are hereby incorporated herein by reference, in their entirety:

U.S. Pat. No. 2,558,975—Combined Door and Ladder in the Side of a Craft

The object of this invention is to provide a ladder which may be let down either by persons outside the vehicle, or, if desired, from within, it is also an object to provide a ladder which when not in use can be retracted into the side or bottom of the vehicle in such a manner as to effect a streamlining of the hull of the at the place where the ladder is retracted. This ladder is particularly useful in life boats which are launched without occupants from aircraft to rescue survivors of a ship or air accident floundering in the water and who have been located by air search. The invention is also adapted for installation in large military airliners or bombers having fuselages which are high off the ground, for boarding them in the event that external portable ladders or ramps are not available.

U.S. Pat. No. 5,537,949—Diver's Boarding Ladder

An improved diver's boarding ladder and dive door for a boat having a dive opening. The boarding ladder is positionable between a boarding position and a storage position without having to be removed and stored. In the boarding position, the dive opening is opened and the boarding ladder extends below the waterline to assist swimmers and divers in boarding the boat from the water. In the storage position, the dive door closes the dive opening and the boarding ladder is stored out of the way inside the boat's hull in an inverted position. The hoarding ladder is secured in the dive opening with a hinge that runs along the entire length of the bottom of the dive opening and acts as a chafe plate to prevent damage to the boat's hull from dive equipment.

U.S. Pat. No. 7,004,101—Boat with Stabilizer Adapted to Serve as a Loading Platform The hull of a boat includes an opening which is closed by a door attached to the hull with a hinge and capable of limited pivoting motion on the hinge with a substantially horizontal axis of the pivot. In its upright first extreme position the door comprises a part of the hull. In a second folded down extreme position the door is substantially parallel with the water surface and can act as a loading platform and also as a stabilizer against wave action in rough waters.

U.S. Pat. No. 7,438,014—Rigid Inflatable Boat with Easy Lifesaving

A rigid inflatable boat adapted for ease of lifesaving includes an arc-shaped front tube fixedly installed at a front side of a hull and a rear tube slideably installed at a rear side of the hull. A respective sliding rail having a guiding member disposed therein extends longitudinally on an upper surface of the hull at one or both sides thereof The rear tube is slideable forward and backward along the sliding rail due to the operation of the guiding member. A first holding means for detachably supporting a rear end of the arc-shaped tube and a front end of the rear tube is installed between the rear end of the arc-shaped tube and the front end of the rear tube. An open space between a rear end of the arc-shaped front tube and a front end of the rear tube provides ease of lifesaving.

U.S. Pat. No. 8,800,470—Dive Door for Rigid Inflatable Boats

A dive door for an inflatable boat configured as a semi-cylindrical body having a planar platform surface and an outer curved surface. The door is hingeably attached to the deck of the boat and is disposed between a first gunwale tubing section and a second gunwale tubing section of the boat. The dive door is selectively operable between a deployed position and a closed position. In the deployed position, the planar platform surface extends outwardly from the boat and the outer curved surface faces downward toward the water. A hydraulic ram may be attached to and disposed between the platform surface and a rigid structure of the boat, whereby the hydraulic ram is translates the door between the deployed position and the closed position. In the closed position, the outer curved surface is coincident with the gunwale tubing such that it appears that the door is integrated into the boat.

U.S. Pat. No. 9,120,540—Marine Vessel Dive Patio

A dive door for a marine vessel comprising a planar body having an interior surface and an exterior surface. The door is disposed between the gunwale of the boat and is hingeably attached to the deck of the boat. The door is releasably retained to the gunwale by one or more latches disposed at a top edge of the dive door. One or more gas shocks are attached to the door and the boat such that the dive door is selectively operable between a deployed position and a closed position. When deployed, the interior surface of the dive door extends outwardly from the boat. In the closed position, the outer surface of the dive door is matches the profile of the gunwale, providing a sleek integrated look. A ladder may hinged to the dive door and is configured to extend downward.

However, each of the above-referenced assemblies suffers from disadvantages. It would be desirable to provide a dive door and ladder assembly, wherein the dive door forms a step or platform when in the open position, and wherein a compartment below the door may house a collapsible ladder that may be extended over the side of the boat beneath the doorway. Such an assembly allows the ladder to be stowed away in a hidden compartment when the diver door is in the closed position, and also offers a platform, raised slightly from the deck of the boat, for divers, snorkelers and the like to enter and exit the boat.

BRIEF SUMMARY OF THE INVENTION

In accordance with one aspect of the invention, a first embodiment of an improved dive door and ladder assembly includes a door positioned on the side of a boat, preferably in a rearward or aft position. The dive door is attached to a horizontally oriented hinge on a bottom portion thereof, and opens by pivoting inwardly and downwardly (vertically). The door is generally the same width (thickness) as the side of the boat, so that the door remains generally flush with the side of the boat, both on the inner wall and the outer hull, when the door is in a closed position.

When the door is in an open position, the underside of the door is generally in a horizontal plane with the upper surface of the doorway, forming a platform for divers and snorkelers to stand on. Preferably, the platform that is formed when the door is in the open position is generally at the same height as a floating dock, which facilitates easy entry and egress between the boat and a dock. The upper surface of the doorway further includes a small hatch that may be opened to reveal a compartment therebelow. A collapsible ladder may be positioned within the compartment, in a collapsed state, and may be pulled upwardly from the compartment and folded over the side of the boat, through the doorway and into the water. The ladder may include an assembly that allows the ladder to be extended and positioned for use in the water, while still being attached to the inside of the compartment, in order to prevent the ladder from being lost overboard or misplaced. Optionally, the ladder attachment assembly may further include means for detachment from the compartment, for cleaning, maintenance or repair.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
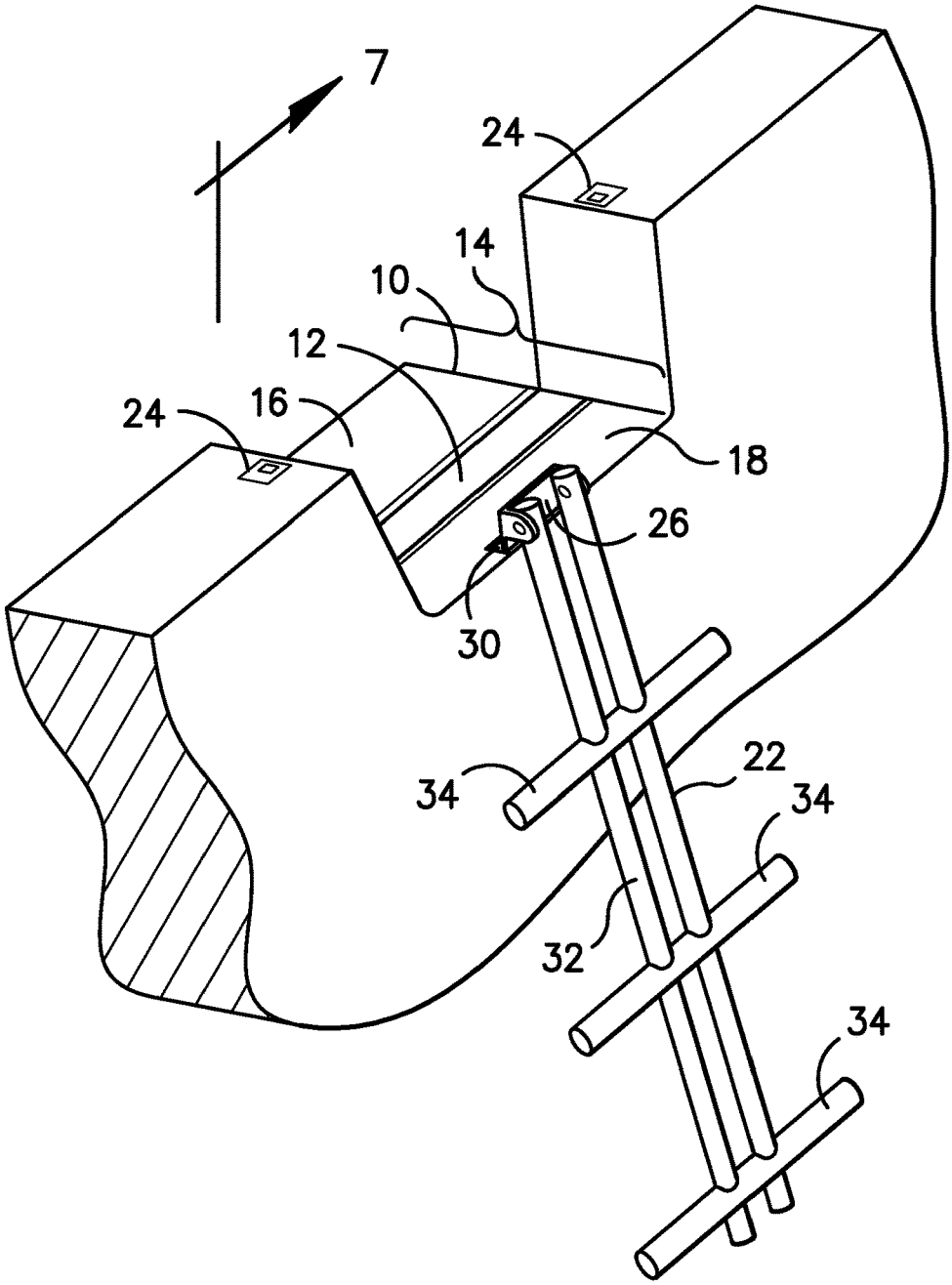
FIG. 1 is a perspective view of one embodiment of a dive door assembly, wherein the ladder is shown in the down position adjacent the side of the boat, and the compartment hatch is in the closed position.
Figure 1:
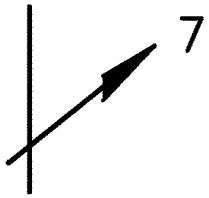

The present invention includes, in a first embodiment, a diver door 10 that includes a hinge on a bottom portion thereof, so that the diver door opens inwardly and swings downwardly in a vertical direction. When the door 10 is in the open position, the bottom surface 12 of the door forms a platform 14 that is generally in the same plane as the upper surface of the doorway 16, as shown in FIG. 1. The platform 14 is preferably raised above the level of the deck, so that a user may step up onto the platform 14 from the deck of the boat prior to entering the water. In a preferred embodiment, the upper surface of the doorway 16 includes a hinged hatch 18 that may be opened to reveal a compartment 20 below the doorway. A collapsible ladder 22 is positioned within the compartment 20 in a collapsed state, and the ladder 22 may be pulled upwardly from the compartment 20, as shown in FIGS. 4 and 6, and folded over the side of the boat and extended downwardly into the water, as shown in FIGS. 1 and 5.

Figure 2A:
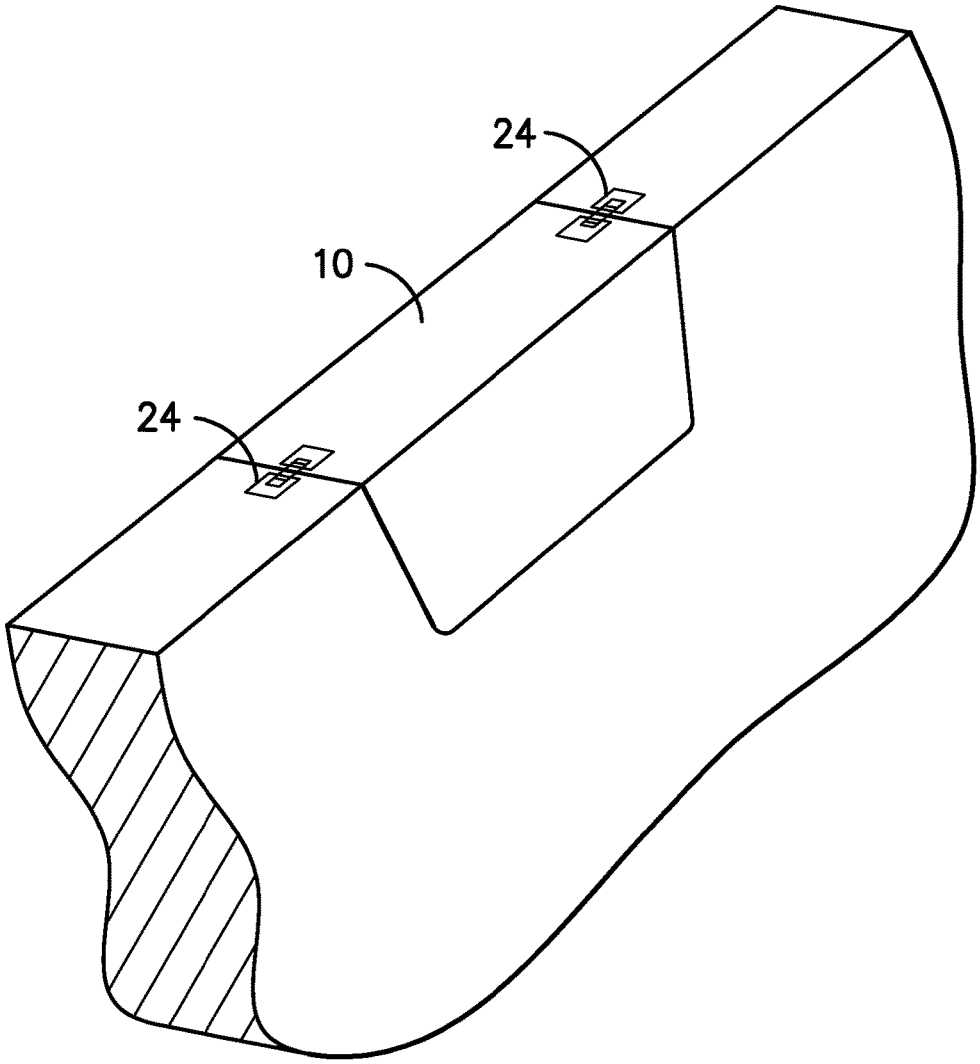
FIG. 2A is a perspective view of one embodiment of a dive door assembly, wherein the door is in a closed position.

The diver door 10, in a preferred embodiment, has a thickness equal to that of the side of the boat, so that the outer surface of the door is flush with the outer hull, and the inner surface of the door is flush with the inner surface of the side wall of the boat, as shown in FIG. 2. Optionally, a strip of sealing material, such as rubber, silicone, or the like, may be positioned between the door and the doorway (when the door is in a closed position), in order to prevent water from leaking through the seams between the door and doorway. One or more latches 24 may lie placed in any desired position for locking the door 10 into a closed position. A pair of latches 24 are shown on an upper surface of the door 10 in FIG. 2.

Figure 4:
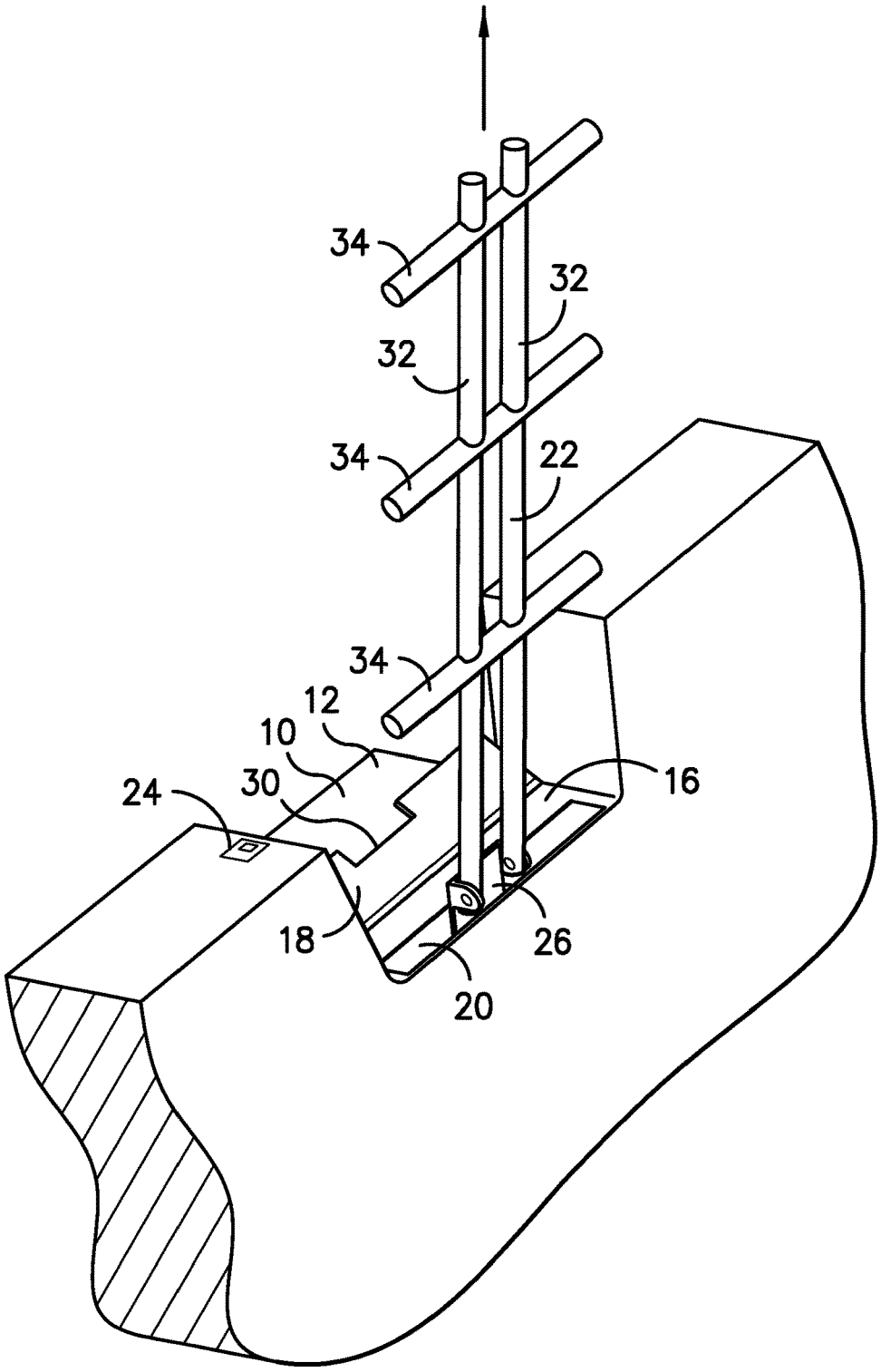
FIG. 4 is a perspective view of one embodiment of a dive door assembly, wherein the door is in an open position, and the ladder is extending upwardly from the storage compartment.
Figure 5:
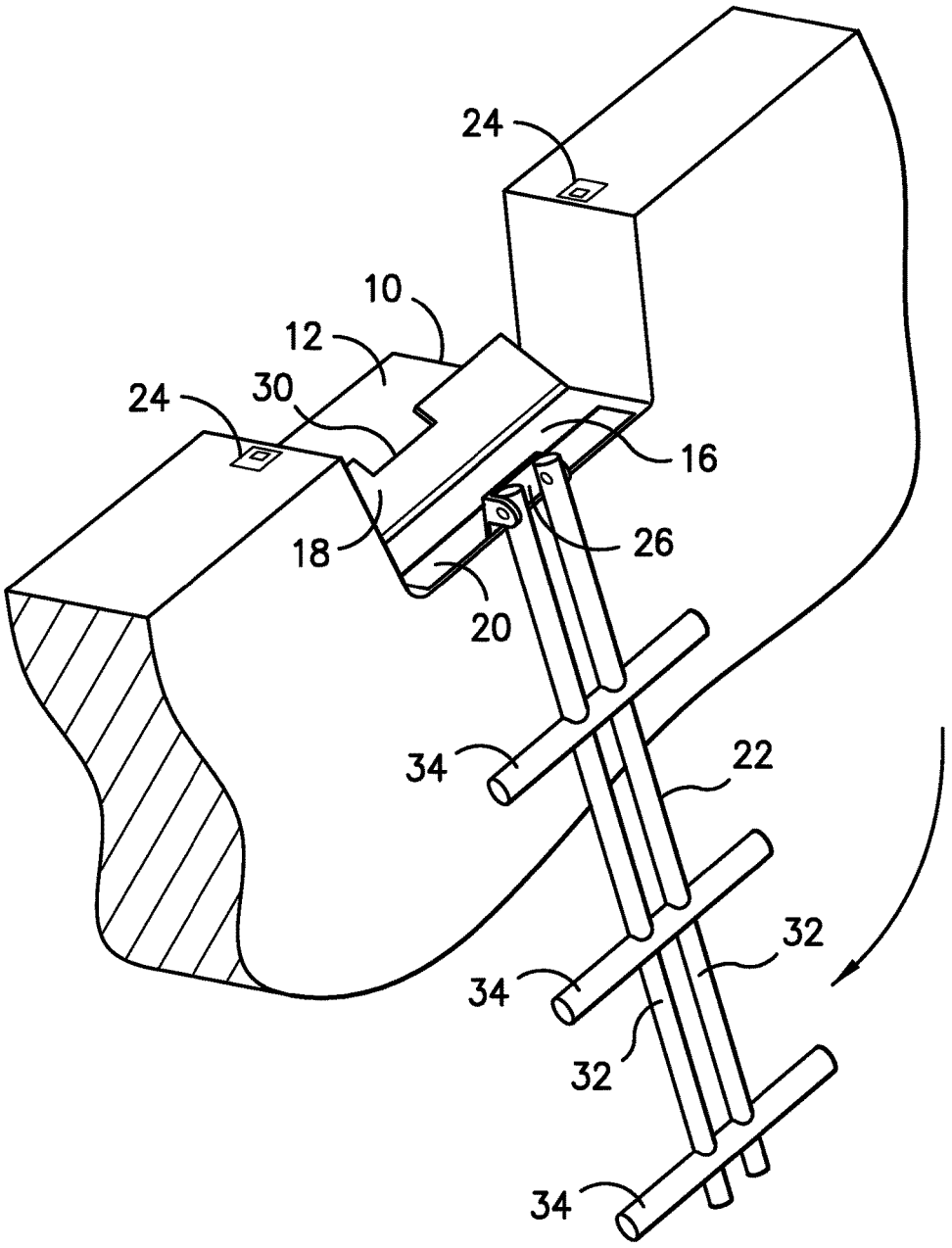
FIG. 5 is a perspective view of one embodiment of a dive door assembly, wherein the ladder is shown in the down position adjacent the side of the boat, and the compartment hatch is in the open position.
Figure 6:
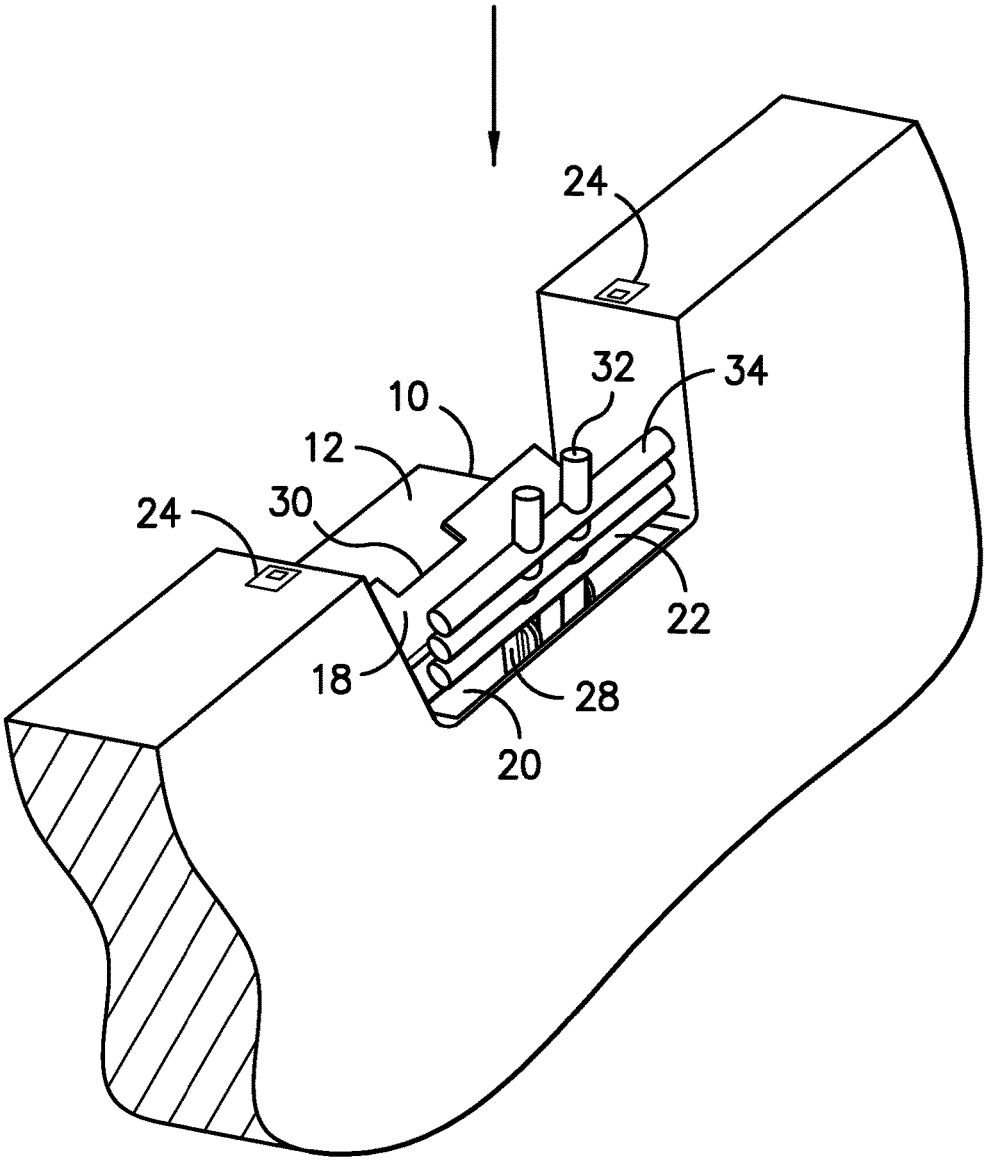
FIG. 6 is a perspective view of one embodiment of a dive door assembly, wherein the ladder is shown in a collapsed position, and wherein the compartment hatch is in the open position.
Figure 7:
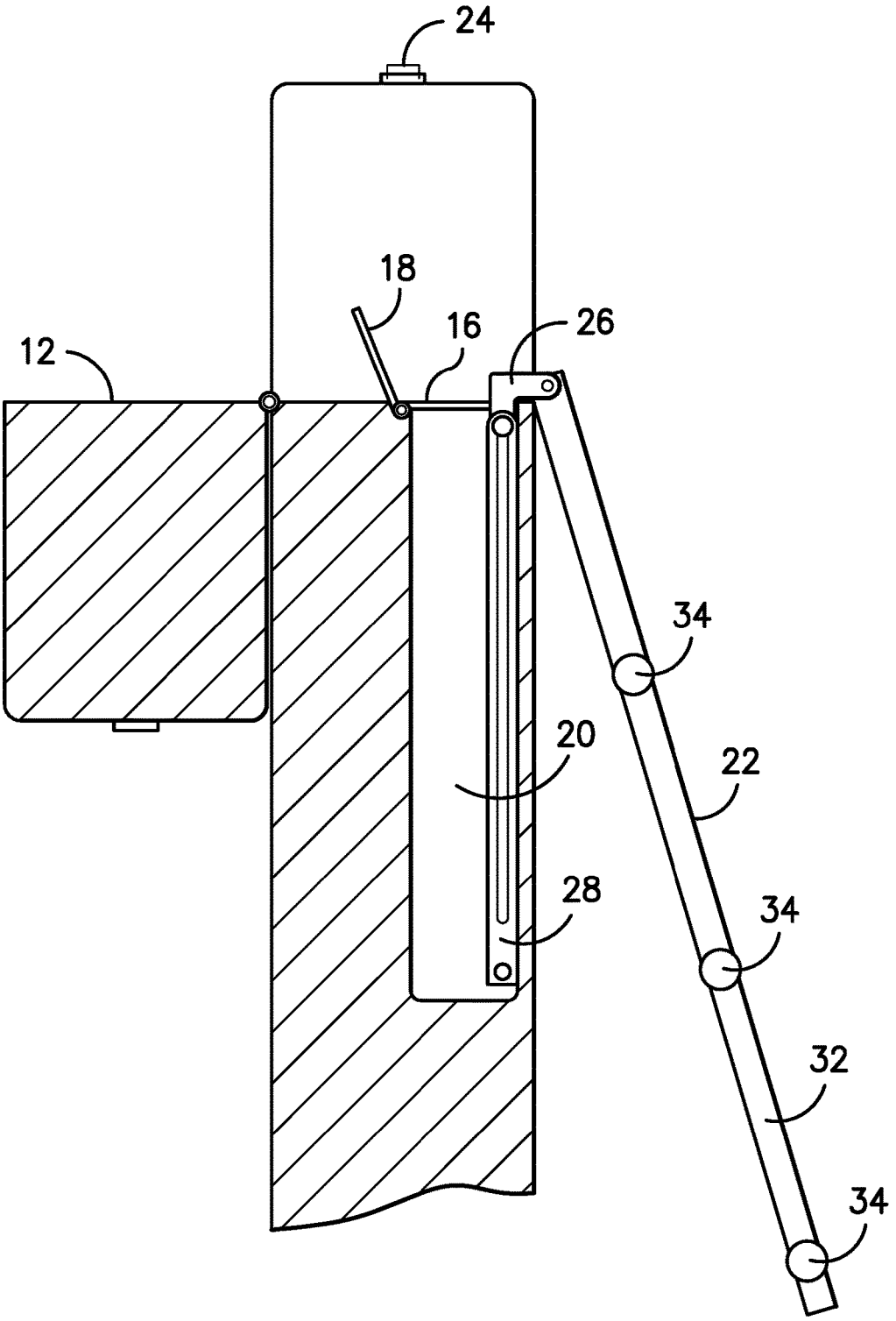
FIG. 7 is a cross-sectional view of one embodiment of a dive door assembly along the lines 7-7, wherein the ladder is shown in the down position adjacent the side of the boat, and wherein the compartment hatch is in the open position.
Figure 8:
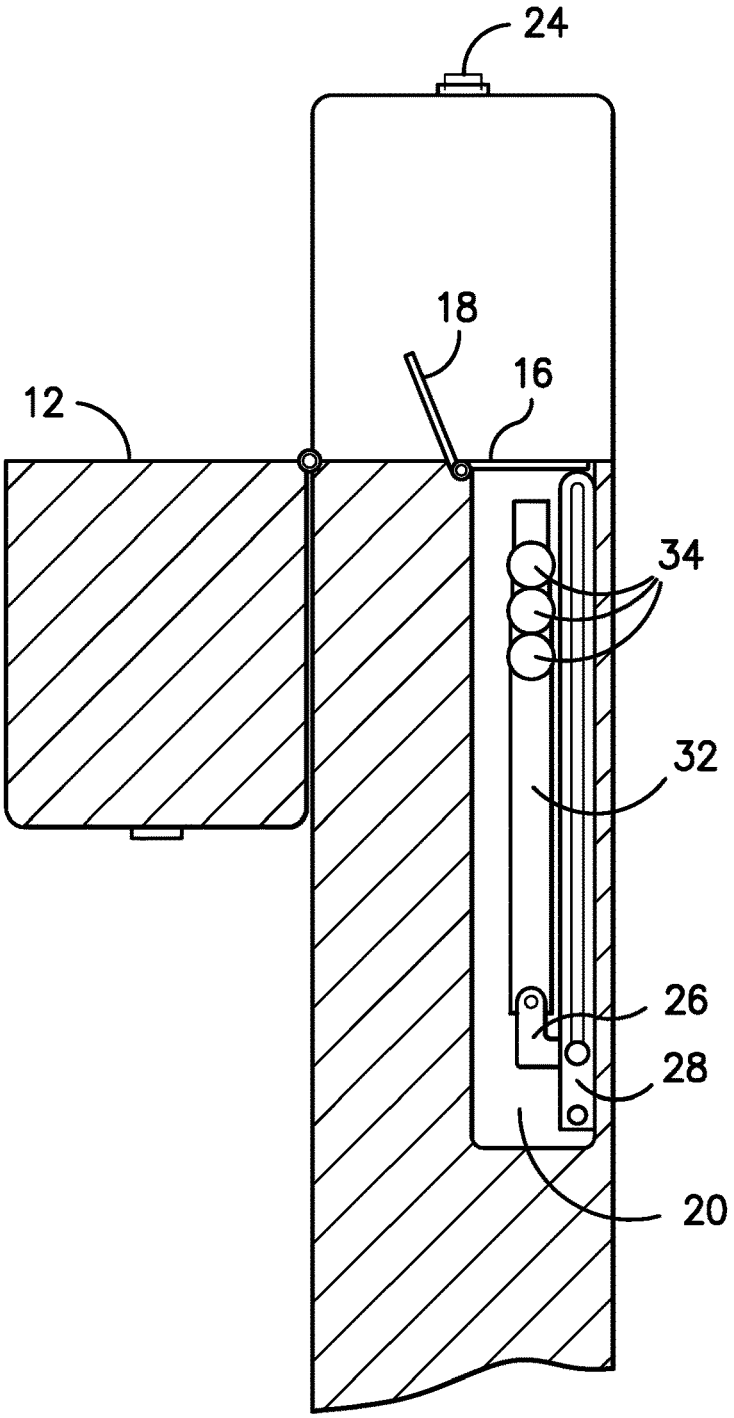
FIG. 8 is a cross-sectional view of one embodiment of a dive door assembly along the lines 7-7, wherein the ladder is shown in a collapsed position within the compartment, and the compartment hatch is in the open position.

The compartment 20 preferably includes a hinged compartment hatch 18 that may be opened in order to pull the ladder 22 out or place the ladder 22 back in, as shown in FIGS. 4 and 6. Otherwise, when the ladder 22 is either in the storage position, or is in the operable position extending down into the water, the hatch 18 may be closed in order to provide a platform for divers and snorkelers to stand on. The platform 14 is formed by the upper surface 16 of the doorway (and compartment hatch 18) on one side of the hinge, and the bottom surface 12 of the door 10 (when the door 10 is in the open position) on the other side of the hinge, as illustrated in FIG. 1.

The ladder 22 is preferably collapsible in a telescopic manner as shown in FIG. 6, although other types of collapsible ladders may be used. In one embodiment, the ladder 22 includes a pivoting attachment 26 at one end that is attached to a vertically oriented track 28 within the compartment 20, so that the ladder 22 may slide upwardly and downwardly along the track 28 within the compartment 20. When the ladder 22 is raised from the compartment 20, the pivoting attachment 26 allows the ladder 22 to be folded over the side of the boat, as illustrated in FIGS. 1 and 5. The hatch 18 may include a notch 30, so that the pivoting attachment 26 may extend through the notch 30 while the hatch 18 is in the closed position, which allows for the ladder 22 to be extended into the water while the hatch 18 is closed, as shown in FIG. 1. This arrangement allows the ladder 22 to remain connected to the compartment 20 (and by extension, the boat) both while the ladder 22 is in the extended position, and when the ladder 22 is collapsed and stored within the compartment 20. Optionally, the ladder 22 may be detached from the track 28 within the compartment 20 for repair, maintenance, cleaning or replacement.

The ladder 22 is preferably formed as a single or double telescoping post 32 having a series of steps 34 extending outwardly from the post 32 on either side thereof, as shown in FIGS. 1, 4, 5 and 6. This arrangement allows a user who is wearing fins or flippers to use the steps 34 more easily, because the fin does not have to fit between posts on either side of the step 34. It is contemplated, however, that other types of collapsible ladders may be used, including rope ladders, and telescoping ladders having two longitudinal posts with rungs or steps in-between.

Optionally, a latch, strap or securing mechanism may be used to securely fasten the ladder 22 in the collapsed state within the compartment 20, in order to keep the ladder 22 from rattling or moving excessively while in the stored position, and particularly while the watercraft is underway in choppy or heavy seas.

Figure 2B:
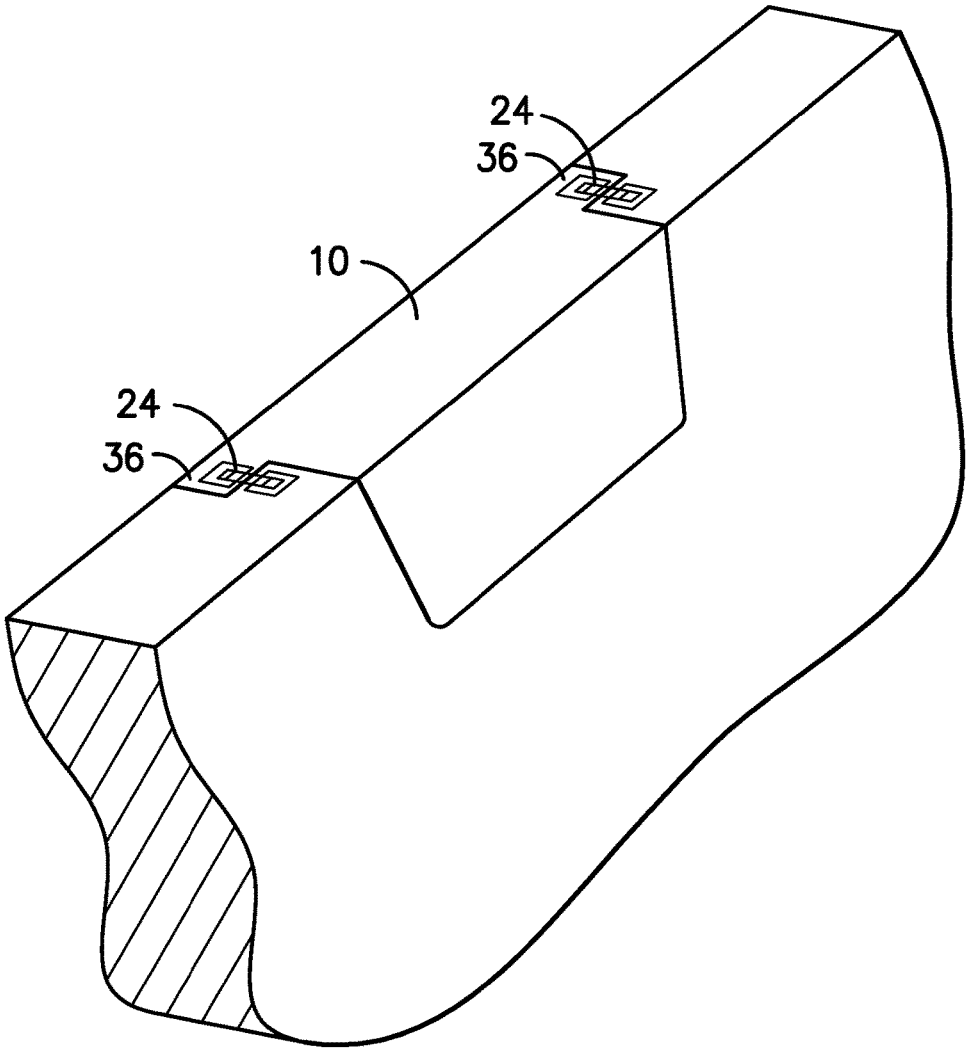
FIG. 2B is a perspective view of another embodiment of a dive door assembly, wherein the door includes an inner lip that extends outwardly from the sides thereof, and wherein the doorway is shaped to accommodate the inner lip of the door to form a watertight seal between the door and doorway when the door is in a closed position.
Figure 3:
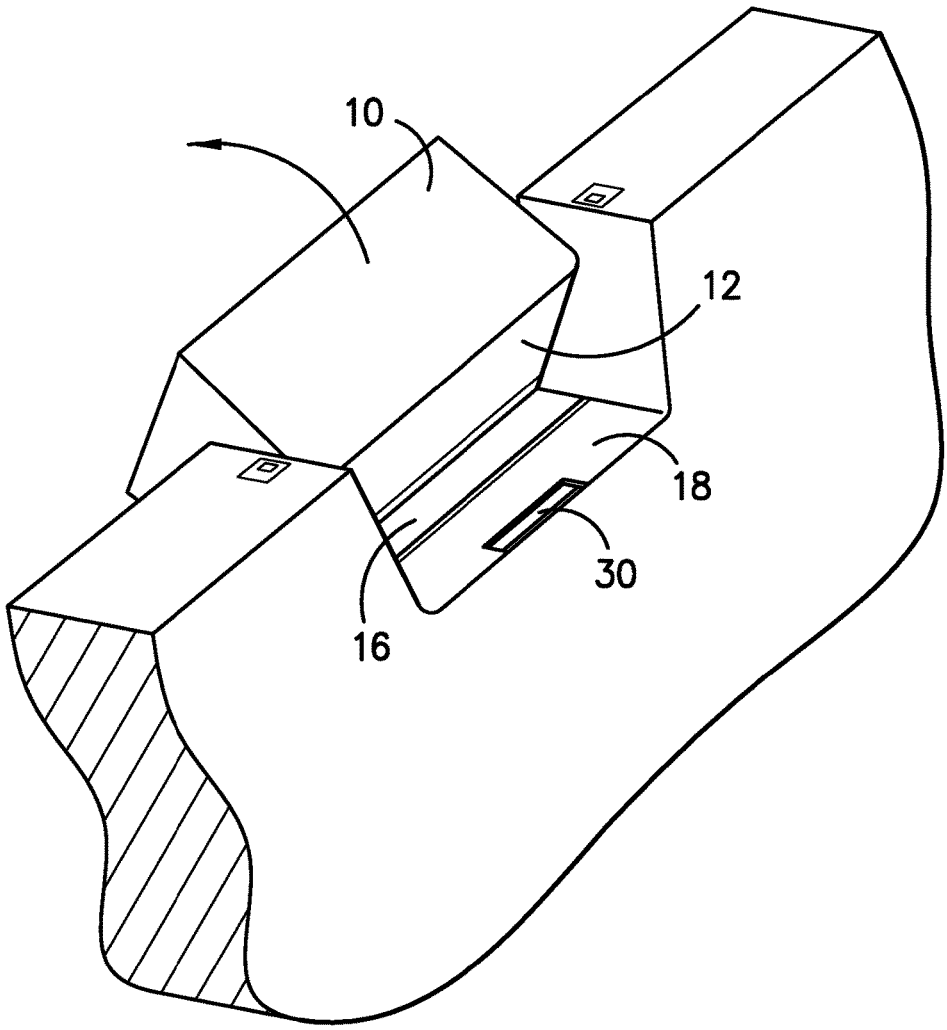
FIG. 3 is a perspective view of one embodiment of a dive door assembly, wherein the door is in a partially opened position.

In one embodiment, the door includes an inner wall that is wider than the outer wall, forming an inner lip 36, as shown in FIG. 2B. This arrangement is particularly advantageous for providing a water-tight seal around the door frame, because a sealing material may be placed around the lip 36 (or door frame), where the lip 36 comes into contact with the door frame or doorway.

Optionally, it is contemplated that the doorway, hatch 18, ladder assembly 22 and compartment 20 may be used without the door, so that there is simply an opening in the hull of the boat, and the compartment hatch 18 opens to reveal the ladder 22 in the collapsed state. The ladder 22 may be extended upwardly from the compartment 20 and dropped over the side of the boat, as described above, and the compartment hatch 18 may then be closed. In this embodiment, the door 10 may be removable, or the assembly may simply be used without a door, so that the doorway is simply a permanent opening in the side of the hull to be used for egress and ingress.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A dive door and ladder assembly for a boat, comprising:

a boat hull defining a doorway;

a door positioned within said doorway, said door having a horizontally oriented hinge on a bottom portion thereof, so that the door pivots inwardly and downwardly in a vertical direction;

said door having a bottom surface, wherein said bottom surface of said door is positioned generally in a plane with an upper surface of said doorway when said door is in an open position, forming a standing platform thereon;

said upper surface of said doorway including a hinged compartment hatch that may open and close, said hatch providing access to a compartment underneath said doorway;

a collapsible ladder positioned in said compartment, wherein said collapsible ladder includes a pivoting attachment to said boat within said compartment so that said ladder may be extended, pivoted outwardly away from said boat, and positioned adjacent an outer side of said hull, beneath said doorway, for ingress and egress of a user.

2. The dive door and ladder assembly set forth in claim 1, wherein said ladder is formed into a telescoping configuration.

3. The dive door and ladder assembly set forth in claim 1, wherein said doorway is positioned on a side of said hull.

4. The dive door and ladder assembly set forth in claim 1, further including a latch for securing said door in a closed position with respect to said doorway.

5. The dive door and ladder assembly set forth in claim 1, wherein said hull includes a deck on an inner portion thereof, and wherein said bottom of said doorway is raised above said deck.

6. The dive door and ladder assembly set forth in claim 1, wherein said ladder is removably attached to said compartment.

7. The dive door and ladder assembly set forth in claim 1, wherein a track is attached to an inner portion of said compartment, and wherein said pivoting attachment on said ladder is slidably attached to said track, so that said ladder may slide upwardly and downwardly along said track.

8. A compartment an adder assembly for a boat, comprising:

a boat hull defining a doorway;

an upper surface of said doorway including a hinged compartment hatch that may open and close, said hinged compartment hatch providing access to a fixed compartment within said boat hull underneath said doorway; and a collapsible ladder positioned in said compartment, wherein said collapsible ladder includes a pivoting attachment to said boat within said compartment so that said ladder may be extended, pivoted outwardly away from said boat, and positioned adjacent an outer side of said hull, beneath said doorway, for ingress and egress of a user.

9. The compartment and ladder assembly set forth in claim 8, wherein said ladder is formed into a telescoping configuration.

10. The compartment and ladder assembly set forth in claim 8, wherein said doorway is positioned on a side of said hull.

11. The compartment and ladder assembly set forth in claim 8, wherein said hull includes a deck on an inner portion thereof, and wherein said bottom of said doorway is raised above said deck.

12. The compartment and ladder assembly set forth in claim 8, wherein said ladder is removably attached to said compartment.

13. The compartment and ladder assembly set forth in claim 8, wherein a track is attached to an inner portion of said compartment, and wherein said pivoting attachment on said ladder is slidably attached to said track, so that said ladder may slide upwardly and downwardly along said track.

* * * * *